US010119703B2

(12) United States Patent
Clark

(10) Patent No.: US 10,119,703 B2
(45) Date of Patent: Nov. 6, 2018

(54) METHOD FOR LOW POWER NON-COKING LIQUID HYDROCARBON FUEL VAPORIZATION AND SUPERCRITICAL PHASE CHANGE

(71) Applicant: U.S. Army Research Laboratory ATTN: RDRL-LOC-I, Adelphi, MD (US)

(72) Inventor: David A. Clark, Cleveland Heights, OH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 793 days.

(21) Appl. No.: 13/803,206

(22) Filed: Mar. 14, 2013

(65) Prior Publication Data

US 2014/0272732 A1 Sep. 18, 2014

(51) Int. Cl.
*F23D 11/44* (2006.01)
*F22B 1/18* (2006.01)

(52) U.S. Cl.
CPC ..... *F23D 11/445* (2013.01); *F22B 1/18* (2013.01)

(58) Field of Classification Search
CPC ..... F23D 11/445; F23D 91/04; F02M 31/18; F02M 1/165; F23K 5/22; C07C 7/005; Y02T 10/126; Y10S 261/83
See application file for complete search history.

(56) References Cited

U.S. PATENT DOCUMENTS 2,967,208 A * 1/1961 Clauson ..... C07C 2/62 585/715
3,633,553 A * 1/1972 Holzapfel ..... F02B 19/1028 123/274
3,807,377 A * 4/1974 Hirschler et al. ..... 123/575
(Continued)

OTHER PUBLICATIONS

KC Tucker, "A Flash Vaporization System for Detonation of Hydrocarbon Fuels in a Pulse Detonation Engine", PhD Dissertation, Air Force Institute of Technology, Wright Patterson AFB, 2005.
(Continued)

*Primary Examiner* — Imran Akram
(74) *Attorney, Agent, or Firm* — Eric Brett Compton

(57) ABSTRACT

Methods for vaporizing hydrocarbon fuel and delivering the hydrocarbon fuel in either a vaporized phase or a supercritical phase to, for example, a combustion chamber are provided herein. A method of vaporizing a hydrocarbon fuel, wherein the hydrocarbon fuel is in a liquid phase at a first temperature and a first pressure, and wherein the first temperature of the liquid phase hydrocarbon fuel is less than its intrinsic oxidation or endothermic reaction temperature, the method may include lowering a pressure of the liquid phase hydrocarbon fuel from the first pressure to a second pressure; and heating the liquid phase hydrocarbon fuel from the first temperature to a second temperature, wherein the hydrocarbon fuel at the second temperature and the second pressure is in a substantially completely vaporized phase substantially without thermally oxidizing the hydrocarbon fuel, and wherein the hydrocarbon fuel in the substantially completely vaporized phase does not form carbonaceous contaminants.

26 Claims, 3 Drawing Sheets

| | Temperature (°F) | Liquid Phase Pressure (bar) | Vapor Phase Pressure (bar) | Liquid Phase Enthalpy (Btu/lbm) | Vapor Phase Enthalpy (Btu/lbm) |
|---|---|---|---|---|---|
| 1 | 200.00 | 0.061240 | 0.022898 | -97.956 | 41.158 |
| 2 | 205.00 | 0.068240 | 0.026165 | -95.237 | 43.313 |
| 3 | 210.00 | 0.075899 | 0.029819 | -92.504 | 45.481 |
| 4 | 215.00 | 0.084266 | 0.033894 | -89.758 | 47.663 |
| 5 | 220.00 | 0.093391 | 0.038431 | -86.998 | 49.857 |
| 6 | 225.00 | 0.10333 | 0.043468 | -84.223 | 52.066 |
| 7 | 230.00 | 0.11412 | 0.049048 | -81.435 | 54.287 |
| 8 | 235.00 | 0.12584 | 0.055218 | -78.633 | 56.521 |
| 9 | 240.00 | 0.13855 | 0.062023 | -75.817 | 58.768 |
| 10 | 245.00 | 0.15229 | 0.069515 | -72.987 | 61.028 |
| 11 | 250.00 | 0.16714 | 0.077748 | -70.143 | 63.300 |

(56) References Cited

U.S. PATENT DOCUMENTS 3,982,910 A * 9/1976 Houseman ..... C01B 3/22 123/3
4,020,811 A * 5/1977 LaForce ..... F02M 33/06 123/548
4,066,043 A * 1/1978 Noguchi ..... F02B 19/1066 123/3
4,267,802 A * 5/1981 Garretson ..... F02M 17/20 123/523
4,375,799 A * 3/1983 Swanson ..... F02M 7/18 123/549
4,396,372 A * 8/1983 Matumoto ..... F23D 11/448 219/206
4,606,319 A * 8/1986 Silva ..... F02M 31/18 123/525
4,644,925 A * 2/1987 Hoppie ..... F02M 27/02 123/557
4,651,682 A * 3/1987 Pefley ..... F02B 43/00 123/1 A
4,681,081 A * 7/1987 LaPan ..... F02M 17/22 123/522
5,533,437 A * 7/1996 Howard ..... B01D 53/1487 95/144
6,232,005 B1 * 5/2001 Pettit ..... B60L 11/1885 429/424
2003/0232298 A1 * 12/2003 Neufeldt ..... F23D 11/445 431/247
2003/0233789 A1 * 12/2003 Dauer ..... B01J 8/0221 48/197 R
2004/0038166 A1 * 2/2004 Yan ..... C10L 1/04 431/207
2004/0164618 A1 * 8/2004 Bryde ..... F02D 19/0647 307/64
2005/0235948 A1 * 10/2005 Hayasaka ..... F02M 59/102 123/255
2006/0242949 A1 * 11/2006 Ueda ..... F01N 3/0842 60/286
2008/0045613 A1 * 2/2008 Dierickx ..... C10G 2/30 518/702
2008/0289609 A1 * 11/2008 Loyd ..... F02M 31/125 123/543
2010/0142934 A1 6/2010 Sellers et al.
2013/0266903 A1 * 10/2013 Mastanduno ..... C01B 3/386 431/11

OTHER PUBLICATIONS

DA Clark, "Investigation and Demonstration of a Small Intermittent Internal Combustion Heavy-Fueled Engine," (slide presentation) American Society of Mechanical Engineers Internal Combustion Engine Division (ICED), 2010 Fall Technical Conference, Sep. 12-15, 2010, San Antonio, TX (presentation given Sep. 13, 2010).

* cited by examiner

| | Temperature (°F) | Liquid Phase Pressure (bar) | Vapor Phase Pressure (bar) | Liquid Phase Enthalpy (Btu/lbm) | Vapor Phase Enthalpy (Btu/lbm) |
|---|---|---|---|---|---|
| 1 | 200.00 | 0.061240 | 0.022898 | -97.956 | 41.158 |
| 2 | 205.00 | 0.068240 | 0.026165 | -95.237 | 43.313 |
| 3 | 210.00 | 0.075899 | 0.029819 | -92.504 | 45.481 |
| 4 | 215.00 | 0.084266 | 0.033894 | -89.758 | 47.663 |
| 5 | 220.00 | 0.093391 | 0.038431 | -86.998 | 49.857 |
| 6 | 225.00 | 0.10333 | 0.043468 | -84.223 | 52.066 |
| 7 | 230.00 | 0.11412 | 0.049048 | -81.435 | 54.287 |
| 8 | 235.00 | 0.12584 | 0.055218 | -78.633 | 56.521 |
| 9 | 240.00 | 0.13855 | 0.062023 | -75.817 | 58.768 |
| 10 | 245.00 | 0.15229 | 0.069515 | -72.987 | 61.028 |
| 11 | 250.00 | 0.16714 | 0.077746 | -70.143 | 63.300 |

| Temperature (°F) | Liquid Phase Pressure (bar) | Vapor Phase Pressure (bar) | Liquid Phase Enthalpy (Btu/lbm) | Vapor Phase Enthalpy (Btu/lbm) |
|---|---|---|---|---|
| 255.00 | 0.18316 | 0.086772 | -67.285 | 65.585 |
| 260.00 | 0.20042 | 0.096652 | -64.413 | 67.862 |
| 265.00 | 0.21900 | 0.10744 | -61.528 | 70.192 |
| 270.00 | 0.23895 | 0.11921 | -58.628 | 72.514 |
| 275.00 | 0.26037 | 0.13202 | -55.714 | 74.848 |
| 280.00 | 0.28333 | 0.14594 | -52.787 | 77.194 |
| 285.00 | 0.30791 | 0.16105 | -49.845 | 79.552 |
| 290.00 | 0.33419 | 0.17741 | -45.889 | 81.921 |
| 295.00 | 0.36225 | 0.19510 | -43.920 | 84.302 |
| 300.00 | 0.39219 | 0.21421 | -40.936 | 86.695 |
| 305.00 | 0.42409 | 0.23482 | -37.938 | 89.098 |
| 310.00 | 0.45804 | 0.25701 | -34.926 | 91.514 |
| 315.00 | 0.49414 | 0.28087 | -31.901 | 93.940 |
| 320.00 | 0.53249 | 0.30649 | -28.851 | 96.377 |
| 325.00 | 0.57318 | 0.33396 | -25.807 | 98.824 |
| 330.00 | 0.61631 | 0.36339 | -22.739 | 101.28 |
| 335.00 | 0.66198 | 0.39486 | -19.656 | 103.75 |
| 340.00 | 0.71031 | 0.42849 | -16.560 | 106.23 |
| 345.00 | 0.76139 | 0.46437 | -13.449 | 108.72 |
| 350.00 | 0.81533 | 0.50262 | -10.325 | 111.22 |
| 355.00 | 0.87225 | 0.54334 | -7.1859 | 113.73 |
| 360.00 | 0.93225 | 0.58665 | -4.0328 | 116.25 |
| 365.00 | 255.00 | 0.63266 | -0.865550 | 118.78 |

METHOD FOR LOW POWER NON-COKING LIQUID HYDROCARBON FUEL VAPORIZATION AND SUPERCRITICAL PHASE CHANGE

GOVERNMENT INTEREST

Governmental Interest—The invention described herein may be manufactured, used and licensed by or for the U.S. Government.

FIELD OF INVENTION

Embodiments of the present invention generally relate to hydrocarbon fuels, more particularly, to a method for vaporizing or effecting a supercritical phase of a hydrocarbon fuel.

BACKGROUND OF THE INVENTION

Typical fuel systems use atomized fuel which produces micron sized liquid fuel particles which must evaporate into vapor during the combustion process. However, some particles may not evaporate quickly enough, leaving fuel unburned during combustion, thereby negatively affecting the overall efficiency of combustion. In addition, very high pressures and heavy associated equipment (e.g., common-rail direct-injection) is necessary to attain atomization. Using fully vaporized fuel resolves the unburned fuel issue. However, heating a hydrocarbon fuel to attain full vaporization potentially requires heating the fuel above certain limits that undesirably initiates thermal oxidation and endothermic reactions within the fuel. Thermal oxidation reactions can cause the formation of carbon particulates and carbonaceous deposits that, for example clog spray nozzles and cake onto surfaces.

Therefore, the inventor has provided an improved method for vaporizing hydrocarbon fuel and optionally initiating a supercritical phase.

BRIEF SUMMARY OF THE INVENTION

Embodiments of the present invention relate to a method for vaporizing a hydrocarbon fuel having a first temperature and a first pressure, wherein the hydrocarbon fuel is in a liquid phase at the first temperature and the first pressure, and wherein the first temperature of the liquid phase hydrocarbon fuel is less than its intrinsic oxidation or endothermic reaction temperature, the method may include lowering a pressure of the liquid phase hydrocarbon fuel from the first pressure to a second pressure; and heating the liquid phase hydrocarbon fuel from the first temperature to a second temperature, wherein the hydrocarbon fuel at the second temperature and the second pressure is in a substantially completely vaporized phase substantially without thermally oxidizing the hydrocarbon fuel, and wherein the hydrocarbon fuel in the substantially completely vaporized phase does not form carbonaceous contaminants.

Embodiments of the present invention relate to a method for delivering a hydrocarbon fuel to a combustion chamber which may include flowing the hydrocarbon fuel from a hydrocarbon fuel source to at least one of a pressure-reducing device or a heat exchanger, wherein the hydrocarbon fuel is in a liquid phase at a first temperature and a first pressure, and wherein the first temperature of the liquid phase hydrocarbon fuel is less than its intrinsic oxidation temperature or endothermic reaction temperature; heating the liquid phase hydrocarbon fuel from the first temperature to a second temperature; flowing the liquid phase hydrocarbon fuel through the pressure-reducing device to reduce a pressure of the liquid phase hydrocarbon fuel from the first pressure to a second pressure, wherein the liquid phase hydrocarbon fuel substantially completely vaporizes at the second temperature and the second pressure within a first duration of time without forming carbonaceous contaminants; flowing the vaporized hydrocarbon fuel through a compressor to increase the pressure of the vaporized hydrocarbon fuel from the second pressure to a third pressure; heating the vaporized hydrocarbon fuel to increase a temperature of the vaporized hydrocarbon fuel from the second temperature to a third temperature, wherein the hydrocarbon fuel is either in a vapor phase at the third pressure and the third temperature or in a supercritical phase at the third pressure and the third temperature; and flowing the completely vaporized hydrocarbon fuel or supercritical hydrocarbon fuel into the combustion chamber.

Other and further embodiments of the invention are described in more detail, below.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE INVENTION

Embodiments of the present invention include methods for vaporizing a hydrocarbon fuel and delivering the hydrocarbon fuel in either a vaporized phase or a supercritical phase to, for example, a combustion chamber. Methods for vaporizing a hydrocarbon fuel and for delivering the hydrocarbon fuel in either a vaporized phase or a supercritical phase to, for example, a combustion chamber in accordance with embodiments of the present invention advantageously facilitate the vaporization and or supercritical phase change of a hydrocarbon fuel with reduced formation of, or without the formation of, carbonaceous contaminants and without initiating endothermic reactions. In addition, methods for vaporizing a hydrocarbon fuel and for delivering the hydrocarbon fuel in either a vaporized phase or a supercritical phase to, for example, a combustion chamber in accordance with embodiments of the present invention advantageously require less power than typical vaporization or supercritical phase change systems. Furthermore, embodiments of the present invention advantageously enable all engines, heaters, and fuel cells to use any type of hydrocarbon fuel.

Figure 1:
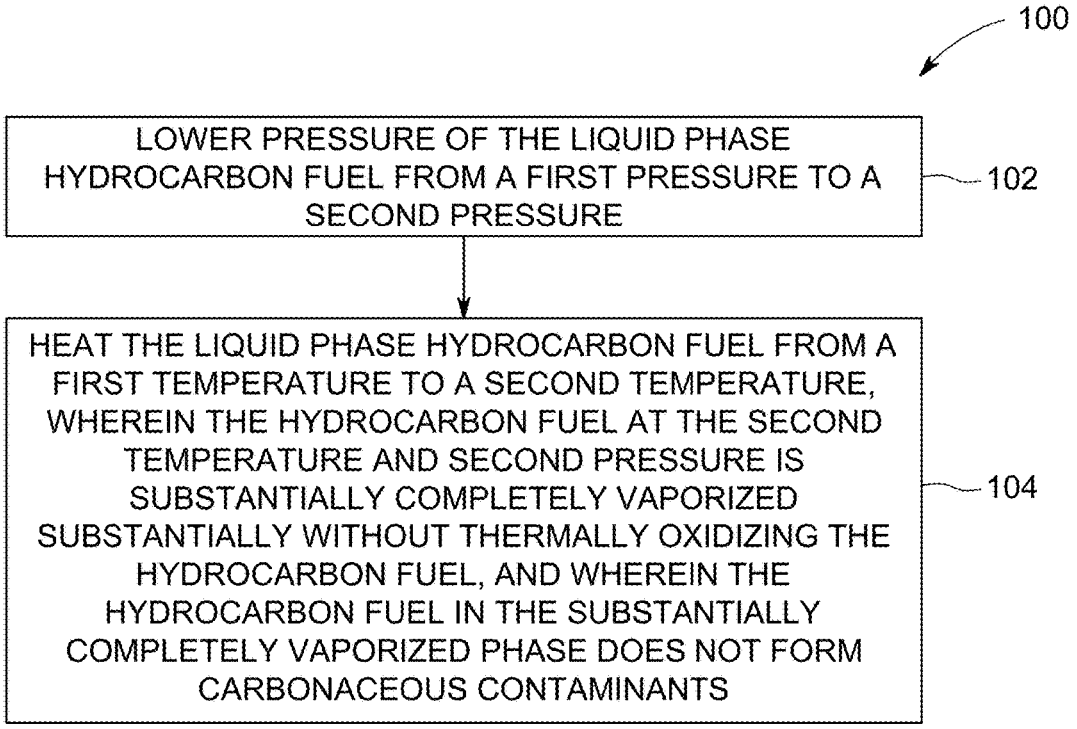
FIG. 1 depicts a flow diagram of a method for vaporizing a hydrocarbon fuel in accordance with some embodiments of the present invention.

FIG. 1 depicts a flow diagram of a method 100 for vaporizing a hydrocarbon fuel in accordance with some embodiments of the present invention. As used herein, the term hydrocarbon fuel refers to a fuel comprising hydrogen and carbon and typically having a thermal oxidation temperature or endothermic reaction temperature at which contaminants form, which is lower than the vaporization temperature of the hydrocarbon fuel. The hydrocarbon fuel to be vaporized is in a liquid phase at a first temperature and first pressure. The first pressure is any pressure where the hydrocarbon fuel is in a liquid phase and the first temperature is any temperature that is less that the intrinsic oxidation temperature or endothermic reaction temperature of the liquid phase hydrocarbon fuel. In some embodiments, the first pressure is an ambient pressure (e.g., about 1 bar) and the first temperature is an ambient temperature (e.g., Standard Day 15° C. (59° F.)). The available range for the first temperature will vary depending on the specific hydrocarbon fuel to be vaporized. As described below with respect to FIG. 3, a pressure-enthalpy chart can be used to determine the first pressure and first temperature for a specific hydrocarbon fuel.

At 102, a pressure of the liquid phase hydrocarbon fuel is lowered from the first pressure to a second pressure. At 104, the liquid phase hydrocarbon fuel is heated from a first temperature to a second temperature.

The hydrocarbon fuel at the second temperature and second pressure is substantially completely, or completely, in a vaporized phase substantially without, or without, thermally oxidizing the hydrocarbon fuel and without initiating endothermic reactions, thereby reducing or preventing formation of carbonaceous contaminants. In some embodiments, the second pressure is a pressure which facilitates vaporization of the hydrocarbon fuel below the oxidation temperature and reaction temperature of the hydrocarbon fuel. In some embodiments, the second pressure may range from the vapor pressure of the hydrocarbon fuel at the lower of either the oxidation temperature or reaction temperature of the hydrocarbon fuel, down to full vacuum. In some embodiments, the available range for the second pressure will vary depending on the second temperature and the specific hydrocarbon fuel to be vaporized. In some embodiments, the second temperature is a temperature below the oxidation temperature and reaction temperature of the hydrocarbon fuel which vaporizes the hydrocarbon fuel at the second pressure. The available range for the second temperature will vary depending on the second pressure and the specific hydrocarbon fuel to be vaporized. As described below with respect to FIG. 3, a pressure-enthalpy chart can be used to determine an appropriate second pressure and second temperature to substantially completely, or completely vaporize a specific hydrocarbon fuel substantially without, or without, the occurrence of thermal oxidization and without initiating endothermic reactions.

In some embodiments, the hydrocarbon fuel is heated from a first temperature to a second temperature and then the pressure is reduced from a first pressure to a second pressure. In some embodiments, the hydrocarbon fuel is heated from a first temperature to a second temperature while simultaneously reducing the pressure from a first pressure to a second pressure. In each of the embodiments described above, the hydrocarbon fuel at the second temperature and second pressure is substantially completely, or completely, vaporized substantially without, or without, thermally oxidizing the hydrocarbon fuel to form carbonaceous contaminants and without initiating endothermic reactions.

In some embodiments, in order to utilize the vaporized fuel, for example within a combustion chamber, the pressure of the vaporized hydrocarbon fuel is increased to a third pressure and the temperature is increased to a third temperature. In some embodiments, the hydrocarbon fuel at the third pressure and the third temperature is maintained in a vaporized state. In some embodiments, the hydrocarbon fuel at the third pressure and the third temperature is in a supercritical phase. In order to maintain the hydrocarbon fuel in a vaporized phase at the third pressure, the temperature must be increased from the second temperature to a third temperature sufficient to maintain the hydrocarbon fuel in a vaporized phase at the third pressure. In some embodiments, the third pressure is substantially the same as the first pressure, for example an ambient pressure (e.g., about 1 bar). In some embodiments, the third pressure has a range of about the combustion chamber pressure to a pressure above the critical point of the hydrocarbon fuel. In some embodiments, the available range for the third pressure will vary depending on the third temperature and the specific hydrocarbon fuel to be vaporized. In some embodiments, the third temperature is a temperature that maintains the hydrocarbon fuel in a vaporized phase. In some embodiments, the third temperature is a temperature that enables the hydrocarbon fuel to enter its supercritical phase. The available range for the third temperature will vary depending on the third pressure and the specific hydrocarbon fuel vaporized. As described below with respect to FIG. 3, a pressure-enthalpy chart can be used to determine an appropriate third pressure and third temperature to maintain a specific hydrocarbon fuel in a vapor phase or a supercritical phase.

While many vaporization systems use pulsed energy to flash vaporize hydrocarbon fuel, such a process requires a large amount of energy. The inventor has observed that vaporizing the liquid phase hydrocarbon fuel at the second pressure advantageously allows the use of a second temperature below the oxidation temperature and reaction temperature of the hydrocarbon fuel. For example, the inventor has observed that the amount of energy needed to vaporize the liquid phase hydrocarbon fuel may be no more than the energy needed to lower the pressure to a second pressure while the second temperature can be obtained using, for example waste heat from a combustion chamber utilizing the hydrocarbon fuel. Therefore, embodiments of the present invention advantageously require less power than typical vaporization or supercritical phase change systems.

Figure 2:
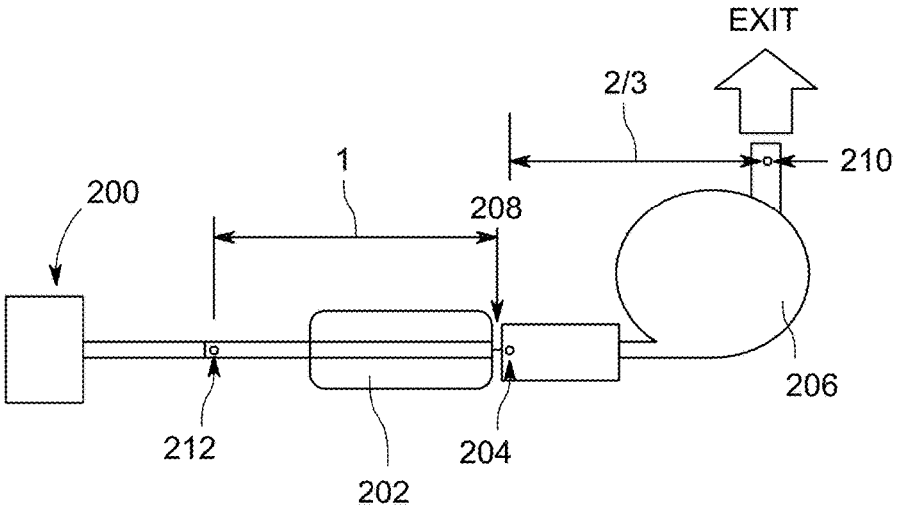
FIG. 2 depicts a schematic diagram of an apparatus for vaporizing and effecting a supercritical phase change of a hydrocarbon fuel in accordance with some embodiments of the present invention.

FIG. 2 depicts a hardware implementation for the method 100 described above in accordance with some embodiments of the present invention. In some embodiments, the hardware implementation depicted in FIG. 2 is coupled to a combustion chamber, such as an engine, to deliver vaporized hydrocarbon fuel or supercritical phase hydrocarbon fuel to the combustion chamber. In some embodiments, the hydrocarbon fuel is in a liquid phase in region 1 between the first thermodynamic point 212 and the second thermodynamic point 204 and in a vaporized phase in regions 2 and 3 between the second thermodynamic point 204 and the third thermodynamic point 210. Regions 1, 2, and 3 in FIG. 2 correspond to regions 1, 2, and 3 in FIGS. 3 and 4 described below. Returning to FIG. 2, in some embodiments, a hydrocarbon fuel source 200 is coupled to a heat exchanger 202 to transfer heat to the hydrocarbon fuel as it passes through the heat exchanger 202. The hydrocarbon fuel is in the liquid phase at a first thermodynamic point 212 having a first temperature and a first pressure. In some embodiments, the first pressure is any pressure where the hydrocarbon fuel is in a liquid phase and the first temperature is less that the intrinsic oxidation temperature or endothermic reaction temperature of the liquid phase hydrocarbon fuel. In some embodiments the first temperature is an ambient temperature (e.g., Standard Day 15° C. (59° F.)), and the first pressure is an ambient pressure (e.g., about 1 bar). The liquid phase hydrocarbon fuel passes through the heat exchanger 202 to increase the temperature of the liquid phase hydrocarbon fuel from the first temperature to a second temperature. The heated liquid phase hydrocarbon fuel then passes through a pressure reducing device, such as an orifice 208, a venturi, a throttling valve, or the like, to lower the pressure of the heated liquid phase hydrocarbon fuel from the first pressure (for example, ambient pressure) to a second pressure lower than the first pressure. After passing through the pressure reducing device the liquid phase hydrocarbon fuel is at a second thermodynamic point 204 having a second temperature and second pressure, wherein the hydrocarbon fuel is advantageously substantially completely, or completely, vaporized substantially without, or without, thermally oxidizing the hydrocarbon fuel to form carbonaceous contaminants and without initiating endothermic reactions. As described above, vaporizing the liquid phase hydrocarbon fuel at the second pressure advantageously allows the use of a second temperature below the oxidation temperature and reaction temperature of the hydrocarbon fuel. For example, the inventor has observed that the amount of energy needed to vaporize the liquid phase hydrocarbon fuel may be no more than the energy needed to lower the pressure to a second pressure while the second temperature can be obtained using, for example waste heat from a combustion chamber utilizing the hydrocarbon fuel.

In some embodiments, the liquid phase hydrocarbon fuel at the first thermodynamic point 212 may be passed through a pressure reducing device to reduce the pressure from the first pressure to the second pressure and then be heated from the first temperature to the second temperature using the heat exchanger 202 to substantially completely, or completely, vaporize the liquid phase hydrocarbon fuel substantially without, or without, thermally oxidizing the hydrocarbon fuel to form carbonaceous contaminants and without initiating endothermic reactions. In some embodiments, the orifice (or pressure reducing device) 208 may be heated to reduce the pressure of the liquid phase hydrocarbon fuel from the first pressure to the second pressure while heating the liquid phase hydrocarbon fuel from the first temperature to the second temperature.

In some embodiments, in order to utilize the vaporized fuel within a combustion chamber the pressure of the vaporized hydrocarbon fuel is increased to a third pressure, such as the ambient pressure, and the temperature is increased to a third temperature. In some embodiments, the hydrocarbon fuel at the third pressure and the third temperature is maintained in a vaporized phase. In order to maintain the hydrocarbon fuel in a vaporized state at the third pressure, the temperature must be increased from the second temperature to a third temperature sufficient to maintain the hydrocarbon fuel in a vaporized state at the third pressure. In some embodiments, the hydrocarbon fuel at the third pressure and the third temperature is in a supercritical phase. In order to alter the hydrocarbon fuel to a supercritical phase, the third pressure and the third temperature must be raised to above the critical point of the hydrocarbon fuel. Thus, the vaporized hydrocarbon fuel is sent through a compressor, such as a vacuum pump (or similar device), and a heater 206 to raise the pressure of the vaporized hydrocarbon fuel from the second pressure to the third pressure while heating the vaporized hydrocarbon fuel from the second temperature to the third temperature. After passing through the compressor and heater 206, the vaporized hydrocarbon fuel is at a third thermodynamic point 210 having the third temperature which maintains the hydrocarbon fuel in either a vaporized phase or supercritical phase at the third pressure.

In some embodiments, the hydrocarbon fuel is a heavy hydrocarbon fuel. In some embodiments, the heavy hydrocarbon fuel is JP-8 fuel. JP-8 fuel is a kerosene type turbine fuel described in military specification document MIL-DTL-83133H, "Turbine Fuel, Aviation, Kerosene Type, JP-8 (NATO F-34), NATO F-35, and JP-8+100 (NATO F-37)" dated Oct. 25, 2011 and incorporated herein by reference. Complete vaporization of JP-8 fuel at ambient pressure (i.e., 1 bar) occurs above 204° Celsius (400° Fahrenheit). However, thermal oxidation reactions and coking, which can begin at JP-8 fuel temperatures between about 120° Celsius (248° Fahrenheit) and about 260° Celsius (500° Fahrenheit), causes the formation of carbonaceous contaminants in fuel systems that clog spray nozzles and cake on interior fuel-system surfaces. The method 100 described above advantageously vaporizes JP-8 fuel while overcoming thermal oxidation and coking issues. In addition, through the use of lower vaporization temperatures, the method 100 described above advantageously uses less power than typical vaporization systems which increase both the temperature and pressure of the target fuel.

Figure 3:
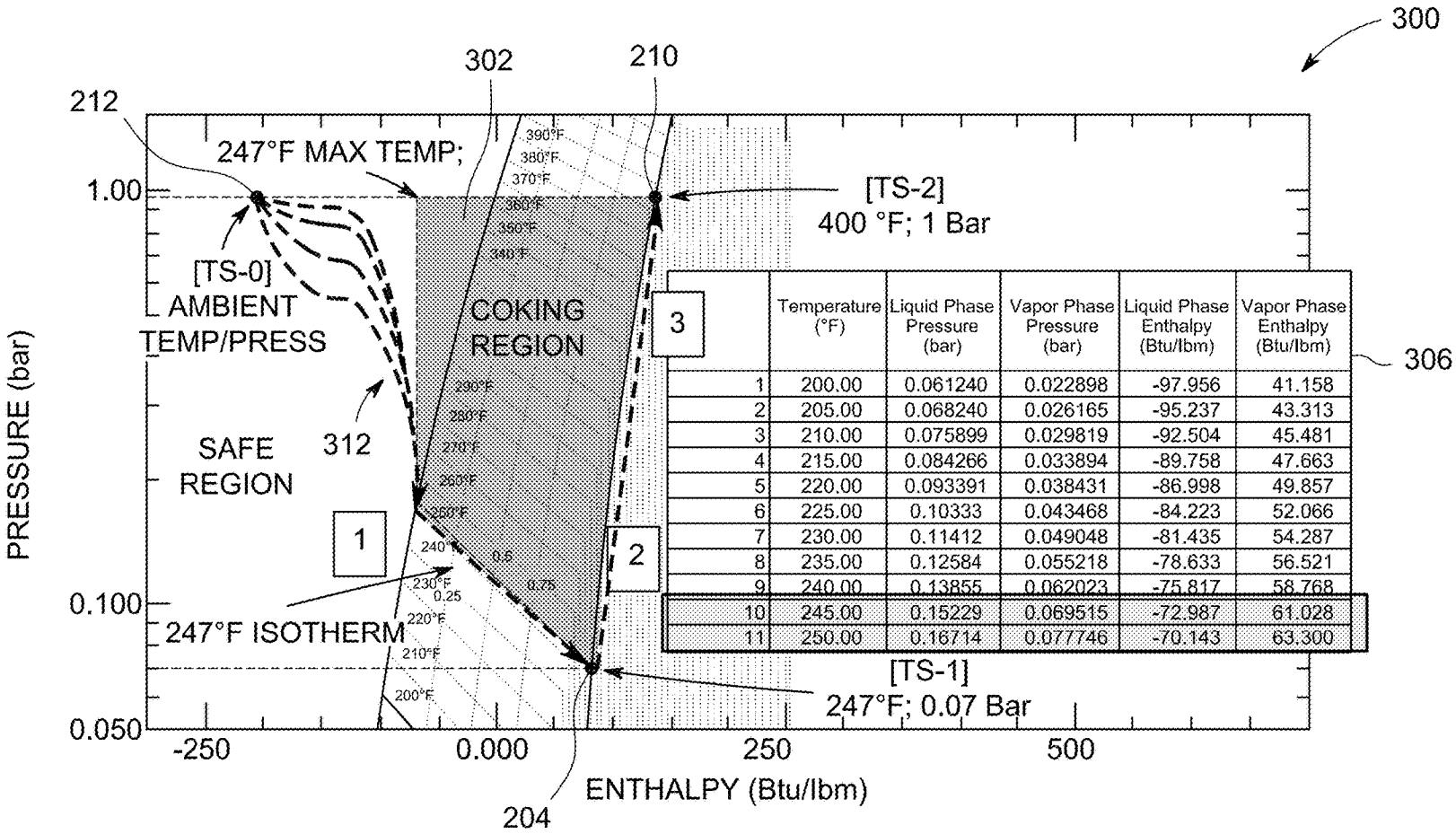
FIG. 3 depicts a pressure vs. enthalpy diagram in accordance with some embodiments of the present invention.

FIG. 3 depicts a pressure vs. enthalpy chart 300 for JP-8 fuel in accordance with some embodiments of the present invention. The chart 300 depicts multiple process paths 312 for liquid phase JP-8 fuel at a first thermodynamic point 212 to reach a second thermodynamic point 204 where the JP-8 fuel is completely vaporized substantially without, or without, thermally oxidizing to form carbonaceous contaminants and without initiating endothermic reactions. The JP-8 fuel begins in a liquid phase at the first thermodynamic point 212 having a first temperature, such as an ambient temperature (e.g., Standard Day 15° C. (59° F.)), and a first pressure, such as an ambient pressure (e.g. 1 bar).

At the second thermodynamic point 204 the JP-8 fuel is completely vaporized at a second temperature of about 120° Celsius (248° Fahrenheit) and a second pressure of about 0.07 bar. Table 306 depicts other exemplary temperature-pressure combinations at which the JP-8 fuel can be completely vaporized without forming carbonaceous contaminants. The inventor has found that 0.07 bar is the approximate maximum pressure that facilitates vaporization of JP-8 fuel below JP-8 reaction temperatures. By lowering the JP-8 pressure further below about 0.07 bar, the JP-8 fuel can be completely vaporized at even lower temperatures, thereby further reducing the chance of inadvertent thermal oxidation and coking.

The multiple process paths 312 represent different hardware configurations that can be implemented to transform the JP-8 fuel from the liquid phase at the first thermodynamic point 212 to the vapor phase at the second thermodynamic point 204. One exemplary hardware configuration is depicted in FIG. 2, wherein the liquid phase JP-8 fuel is heated and then has the pressure reduced to vaporize the liquid JP-8 fuel. Other possible hardware configurations are described above, such as reducing the pressure of the JP-8 fuel followed by heating the JP-8 fuel or simultaneously reducing the pressure of the JP-8 fuel and heating the JP-8 fuel. As depicted in FIG. 3, the multiple process paths 312 reach the second thermodynamic point 204 without traversing the coking region 302. The coking region 302 represents pressure-temperature combinations at which the JP-8 fuel will thermally oxidize to form carbonaceous contaminants, and (or also) initiate endothermic reactions. The pressure and temperature of the vaporized JP-8 fuel is then increased to reach the third thermodynamic point 210. The JP-8 fuel at the third thermodynamic point 210 has a third pressure and third temperature that maintains the JP-8 fuel in a vapor phase. For example the JP-8 fuel at the third thermodynamic point 210 has a third pressure at the ambient pressure (e.g. 1 bar) and a third temperature of 204° Celsius (400° Fahrenheit). In some embodiments, the JP-8 fuel can have a third pressure and third temperature above the critical point of the JP-8 fuel, resulting in a supercritical phase for the JP-8 fuel. In some embodiments, the third pressure is about 23.4 bar and the third temperature is about 410° Celsius (770° Fahrenheit) for the JP-8 fuel to be in a supercritical phase.

Figure 4:
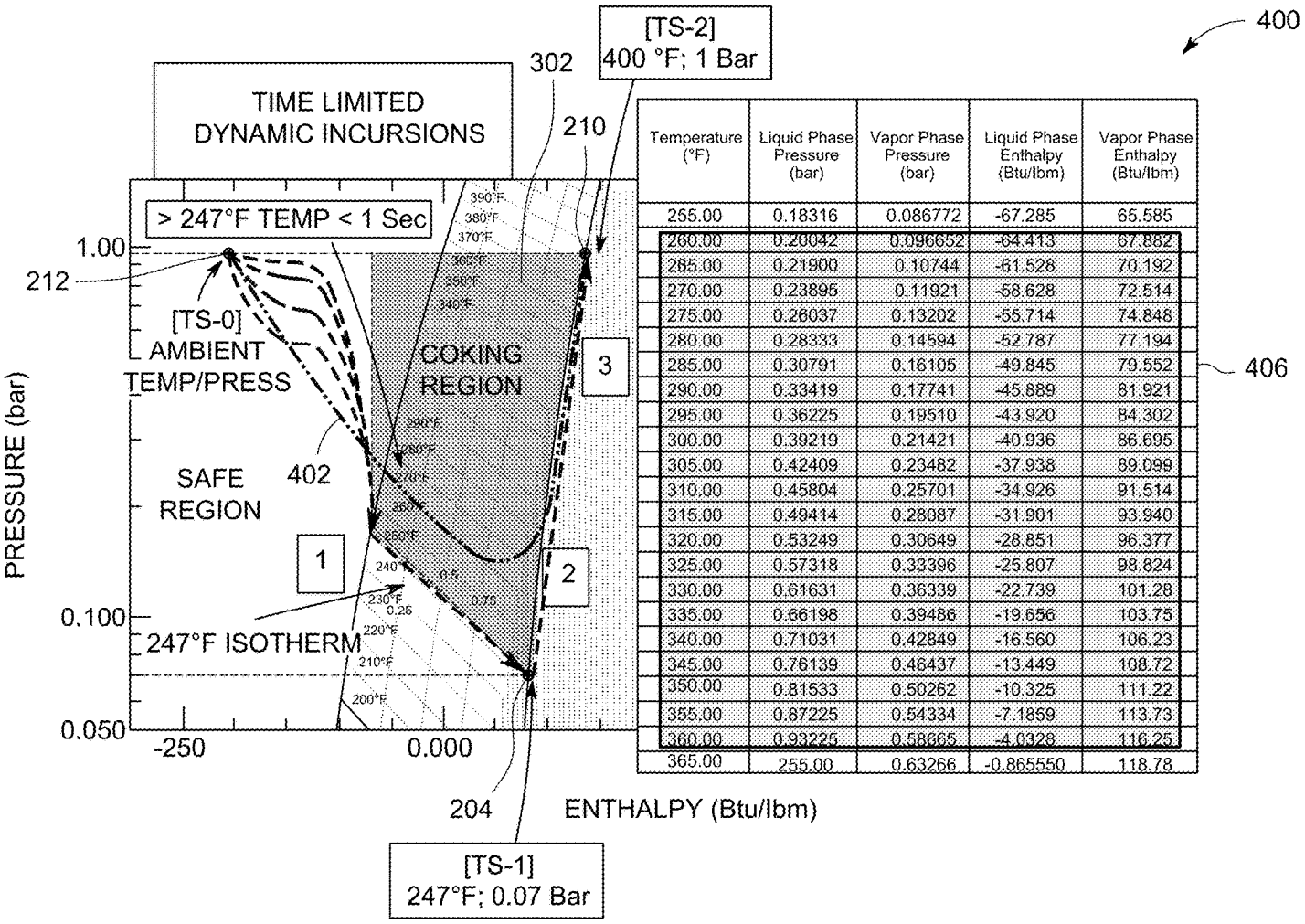
FIG. 4 depicts a pressure vs. enthalpy diagram in accordance with some embodiments of the present invention.

In FIG. 4, the pressure vs. enthalpy chart 400 for JP-8 fuel depicts a process path 402 for liquid phase JP-8 fuel at the first thermodynamic point 212, wherein, instead of avoiding the coking region 302 to reach the second thermodynamic point 204, the process path 402 goes through the coking region 302 by heating the JP-8 fuel at a temperature greater than 120° Celsius (248° Fahrenheit). However, in order to avoid thermal oxidation of the hydrocarbon fuel and avoid endothermic reactions, the process path 402 traverses the coking region 302 within a first duration of time, which is insufficient for the JP-8 to thermally oxidize or initiate endothermic reactions. In some embodiments, the JP-8 fuel is completely vaporized in less than about one second. The pressure and temperature of the vaporized JP-8 fuel is then increased to reach the third thermodynamic point 210. The JP-8 fuel at the third thermodynamic point 210 has a third pressure and third temperature that maintains the JP-8 fuel in a vapor phase. For example the JP-8 fuel at the third thermodynamic point 210 has a third pressure at the ambient pressure (e.g. 1 bar) and a third temperature of 204° Celsius (400° Fahrenheit). In some embodiments, the JP-8 fuel can have a third pressure and third temperature above the critical point of the JP-8 fuel, resulting in a supercritical phase for the JP-8 fuel. In some embodiments, the third pressure is about 23.4 bar and the third temperature is about 410° Celsius (770° Fahrenheit) for the JP-8 fuel to be in a supercritical phase. Table 406 depicts pressure and temperature combinations at which the process path 402 of the JP-8 fuel traverses the coking region 302 requiring the JP-8 fuel to be vaporized in less than about one second.

While the foregoing is directed to embodiments of the present invention, other and further embodiments of the invention may be devised without departing from the basic scope thereof.

The invention claimed is:

1. A method of vaporizing a hydrocarbon fuel comprising:

lowering a pressure of the liquid phase hydrocarbon fuel from a first pressure to a second pressure; and heating the liquid phase hydrocarbon fuel from a first temperature to a second temperature, wherein the hydrocarbon fuel is in a liquid phase at the first temperature and the first pressure, and wherein the first temperature of the liquid phase hydrocarbon fuel is less than its intrinsic oxidation or endothermic reaction temperature;

wherein the hydrocarbon fuel at the second temperature and the second pressure is in a substantially completely vaporized phase substantially without thermally oxidizing the hydrocarbon fuel, and wherein, in going to the substantially completely vaporized phase, no carbonaceous contaminants are formed in the hydrocarbon fuel; and wherein thermal oxidation of the hydrocarbon fuel avoided is not combustion.

2. The method of claim 1, further comprising:

heating the hydrocarbon fuel in the substantially completely vaporized phase from the second temperature to a third temperature while raising the pressure of the hydrocarbon fuel in the substantially completely vaporized phase from the second pressure to a third pressure, wherein the third temperature maintains the hydrocarbon fuel in the substantially completely vaporized phase at the third pressure.

3. The method of claim 1, further comprising:

heating the hydrocarbon fuel in the substantially completely vaporized phase from the second temperature to a third temperature while raising the pressure of the hydrocarbon fuel in the substantially completely vaporized phase from the second pressure to a third pressure, wherein the hydrocarbon fuel is in a substantially completely supercritical phase at the third temperature and third pressure.

4. The method of claim 1, wherein the liquid phase hydrocarbon fuel at the second temperature and second pressure is in a substantially completely vaporized phase within a first duration of time substantially without thermally oxidizing the hydrocarbon fuel in order to avoid formation of carbonaceous contaminants.

5. The method of claim 1, wherein the hydrocarbon fuel is a heavy hydrocarbon fuel.

6. The method of claim 5, wherein the heavy hydrocarbon fuel is a JP-8fuel.

7. The method of claim 6, wherein the first temperature is an ambient temperature and the first pressure is an ambient pressure.

8. The method of claim 7, wherein the hydrocarbon fuel is in a substantially completely vaporized phase at the second temperature of about 120° Celsius (248° Fahrenheit) and the second pressure of about 0.07 bar.

9. The method of claim 8, wherein the hydrocarbon fuel remains in a substantially completely vaporized phase at a third temperature of about 204° Celsius (400° Fahrenheit) and a third pressure at about the ambient pressure.

10. The method of claim 6, wherein the first pressure is about 1 bar and the second pressure is between about 0.07 bar and about 1 bar.

11. The method of claim 10, further comprising heating the JP-8 fuel to a second temperature at the second pressure for a first duration of time, wherein the first duration does not provide sufficient time for the JP-8 fuel to substantially thermally oxidize and form carbonaceous contaminants.

12. The method of claim 11, wherein the first duration is less than about one second.

13. The method of claim 1, wherein one of the following sequences of steps occurs:

(a) lowering the pressure of the liquid phase hydrocarbon from the first pressure to the second pressure precedes heating the liquid phase hydrocarbon from the first temperature to the second temperature;

(b) heating the liquid phase hydrocarbon from the first temperature to the second temperature precedes lowering the pressure of the liquid phase hydrocarbon from the first pressure to the second pressure; or (c) heating the liquid phase hydrocarbon from the first temperature to the second temperature occurs simultaneously with lowering the pressure of the liquid phase hydrocarbon from the first pressure to the second pressure.

14. The method of claim 1, wherein heating the liquid phase hydrocarbon fuel from the first temperature to the second temperature does not result in combustion of the hydrocarbon fuel.

15. The method of claim 1, wherein lowering the pressure of the liquid phase hydrocarbon fuel from the first pressure to the second pressure comprises passing the liquid phase hydrocarbon fuel through a pressure reducing device.

16. The method of claim 1, wherein the hydrocarbon fuel passes from a first thermodynamic point on a pressure vs. enthalpy chart, at the first temperature and the first pressure, to a second thermodynamic point on the pressure vs. enthalpy chart, at the second temperature and the second pressure, without traversing a coking region on the pressure vs. enthalpy chart.

17. The method of claim 16, wherein the hydrocarbon fuel passes from the second thermodynamic point on the pressure vs. enthalpy chart, at the second temperature and the second pressure, to a third thermodynamic point on the pressure vs. enthalpy chart, at a third temperature and a third pressure, traversing through the coking region quickly enough so that the hydrocarbon fuel does not substantially thermally oxidize and form carbonaceous contaminants.

18. A method of delivering a hydrocarbon fuel to a combustion chamber, comprising:

flowing the hydrocarbon fuel from a hydrocarbon fuel source to at least one of a pressure-reducing device or a heat exchanger, wherein the hydrocarbon fuel is in a liquid phase at a first temperature and a first pressure, and wherein the first temperature of the liquid phase hydrocarbon fuel is less than its intrinsic oxidation temperature or endothermic reaction temperature;

heating the liquid phase hydrocarbon fuel from the first temperature to a second temperature;

flowing the liquid phase hydrocarbon fuel through the pressure-reducing device to reduce a pressure of the liquid phase hydrocarbon fuel from the first pressure to a second pressure, wherein the liquid phase hydrocarbon fuel substantially completely vaporizes at the second temperature and the second pressure within a first duration of time without forming carbonaceous contaminants;

flowing the vaporized hydrocarbon fuel through a compressor to increase the pressure of the vaporized hydrocarbon fuel from the second pressure to a third pressure;

heating the vaporized hydrocarbon fuel to increase a temperature of the vaporized hydrocarbon fuel from the second temperature to a third temperature, wherein the hydrocarbon fuel is either in a vapor phase at the third pressure and the third temperature or in a supercritical phase at the third pressure and the third temperature; and flowing the completely vaporized hydrocarbon fuel or supercritical hydrocarbon fuel into the combustion chamber where combustion occurs.

19. The method of claim 18, wherein the hydrocarbon fuel is a JP-8 fuel.

20. The method of claim 19, wherein the second temperature is about 120 ° Celsius (248° Fahrenheit) and the second pressure is about 0.07 bar.

21. The method of claim 18, wherein the first temperature is an ambient temperature and the first pressure is an ambient pressure.

22. The method of claim 21, wherein the third temperature is about 204 ° Celsius (400° Fahrenheit) and the third pressure is the ambient pressure.

23. The method of claim 22, wherein the first temperature is an ambient temperature and the second temperature is above about 120° Celsius (248° Fahrenheit).

24. The method of claim 18, wherein the first pressure is about 1 bar and the second pressure is between about 0.07 bar and about 1 bar.

25. The method of claim 24, wherein the first duration of time is less than about one second.

26. A method of vaporizing a hydrocarbon fuel comprising:

lowering a pressure of the liquid phase hydrocarbon fuel from a first pressure to a second pressure, wherein the hydrocarbon fuel is in a liquid phase at the first temperature and the first pressure, and wherein the first temperature of the liquid phase hydrocarbon fuel is less than its intrinsic oxidation or endothermic reaction temperature;

heating the liquid phase hydrocarbon fuel from a first temperature to a second temperature; and heating the hydrocarbon fuel to a second temperature at the second pressure for a first duration of time to substantially completely vaporize the hydrocarbon fuel, wherein the first duration does not provide sufficient time for the hydrocarbon fuel to substantially thermally oxidize and form carbonaceous contaminants, wherein thermal oxidation of the hydrocarbon fuel avoided is not combustion.

* * * * *